US005739816A

United States Patent [19]

Kobayashi et al.

[11] Patent Number: 5,739,816

[45] Date of Patent: Apr. 14, 1998

[54] ANALOG VIDEO SIGNAL COMPENSATING APPARATUS AND TFT LIQUID CRYSTAL DISPLAY DEVICE

[75] Inventors: Yoshinao Kobayashi, Hiratsuka; Yoshitami Sakaguchi, Yokohama, both of Japan

[73] Assignee: International Business Machines Corporation, Armonk, N.Y.

[21] Appl. No.: 571,745

[22] Filed: Dec. 13, 1995

[30] Foreign Application Priority Data

Dec. 13, 1994 [JP] Japan ..... 6-308526

[51] Int. Cl.[6] ..... G09G 5/00

[52] U.S. Cl. ..... 345/204; 345/98; 345/101; 345/212

[58] Field of Search ..... 345/98, 101, 147, 345/204, 212

[56] References Cited

U.S. PATENT DOCUMENTS 4,789,824 12/1988 Henkelmann .
5,179,345 1/1993 Jenkins et al. .
5,414,441 5/1995 Memarzadeh et al. ..... 345/101
5,489,910 2/1996 Kuwata et al. ..... 345/212
5,561,381 10/1996 Jenkins et al. .

*Primary Examiner*—Richard Hjerpe
*Assistant Examiner*—Juliana S. Kim
*Attorney, Agent, or Firm*—Ronald L. Drumheller

[57] ABSTRACT

A driver for the TFT liquid crystal display panel is provided which can accommodate chip dispersion, and drift of temperature and supplied voltages. A reference voltage generated by a reference voltage generator is input by a control circuit to a display cell equivalent circuit driven by a buffer amplifier equivalent circuit and a control circuit, and its response is output from a TFT emulator circuit. Then, a difference detecting circuit compares the output and the reference voltage from the reference voltage generator, and outputs an output signal corresponding to its difference to a compensating circuit. The compensating circuit compensates analog video signals generated in the previous stage with such output. The compensated analog video signals are output to a TFT liquid crystal display panel through a sample hold circuit and a buffer amplifier.

6 Claims, 4 Drawing Sheets

FEED-FORWARD CIRCUIT 19
+OUTPUT (+VIDEO)
ANALOG VIDEO SIGNAL
AMP 1
-OUTPUT (-VIDEO)
REFERENCE VOLTAGE GENERATOR 7
SIGNAL INVERTER CIRCUIT 9
Vref
+Vref
-Vref
+Vtft
-Vtft
AMP 2a
AMP 2b
+offset
-offset
DIFFERENTIAL AMPLIFIER 13
ANALOG SWITCH 31
ANALOG SWITCH 37
TFT0 G0
TFT1 G1
TFT2 G0
TFT3 G1
33
35
11
CONTROL SIGNAL 1
CONTROL SIGNAL 2
GATE 0 GATE 1 CONTROL CIRCUIT
17

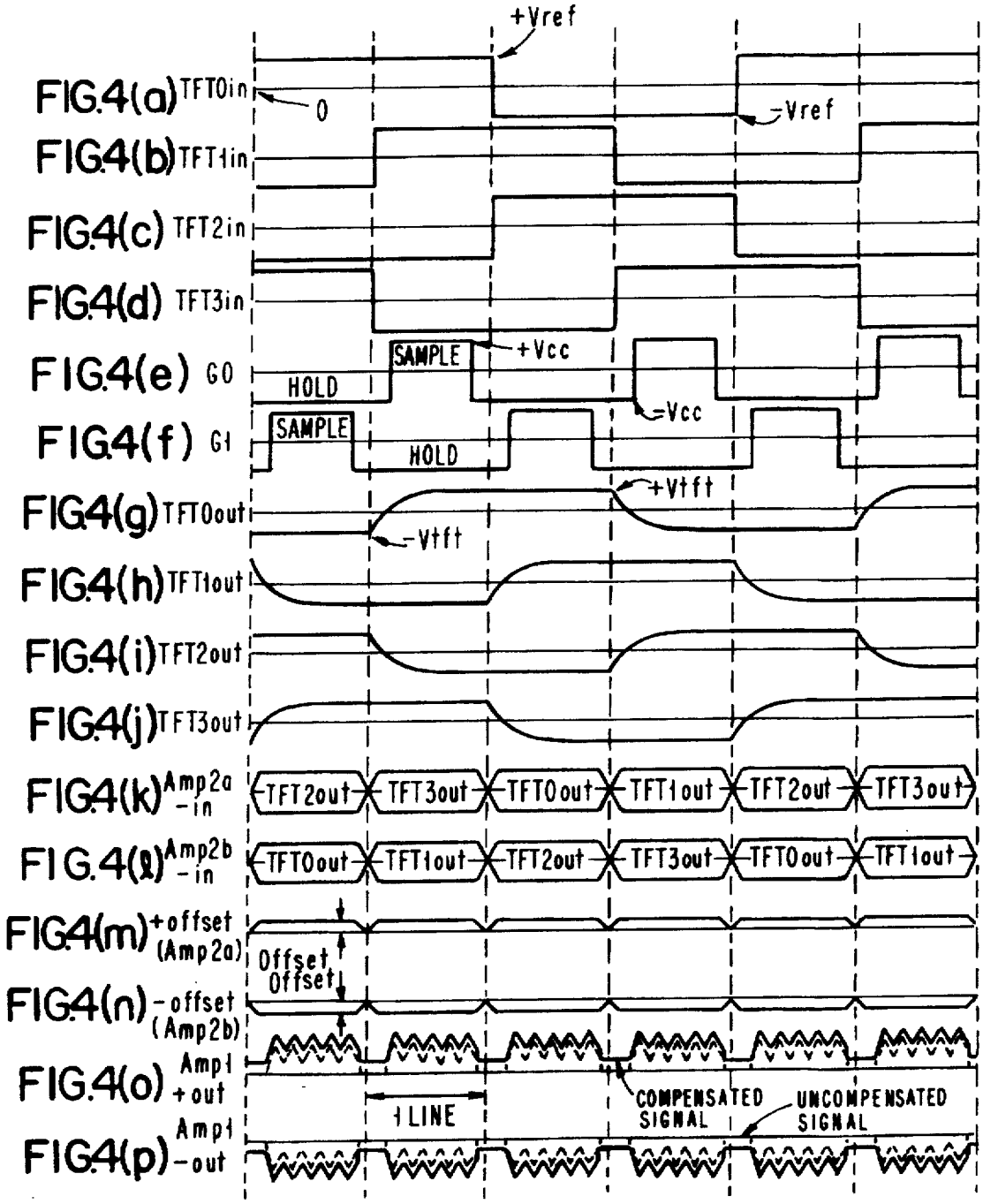
+Vref
FIG.4(a) TFT0in
0
-Vref
FIG.4(b) TFT1in
FIG.4(c) TFT2in
FIG.4(d) TFT3in
FIG.4(e) G0
SAMPLE
+Vcc
HOLD
-Vcc
FIG.4(f) G1
SAMPLE
HOLD
+Vtft
FIG.4(g) TFT0out
-Vtft
FIG.4(h) TFT1out
FIG.4(i) TFT2out
FIG.4(j) TFT3out
FIG.4(k) Amp2a -in
TFT2out TFT3out TFT0out TFT1out TFT2out TFT3out
FIG.4(l) Amp2b -in
TFT0out TFT1out TFT2out TFT3out TFT0out TFT1out
FIG.4(m) +offset (Amp2a)
Offset
Offset
FIG.4(n) -offset (Amp2b)
FIG.4(o) Amp1 +out
1 LINE
COMPENSATED SIGNAL
UNCOMPENSATED SIGNAL
FIG.4(p) Amp1 -out

ANALOG VIDEO SIGNAL COMPENSATING APPARATUS AND TFT LIQUID CRYSTAL DISPLAY DEVICE

BACKGROUND OF THE INVENTION

1. Field of the Invention

The present invention relates to a driver for a TFT liquid crystal display panel, and, more particularly, to a compensation circuit for analog video signals in an analog driver of a TFT liquid crystal display panel.

2. Related Art

The TFT liquid crystal display panel consists of a combination of data lines running in the longitudinal direction of the screen and corresponding to resolution of the screen in the lateral direction (the number of which becomes three folds when three colors of RGB are taken into account), and gate lines running in the lateral direction of the screen and corresponding to resolution in the longitudinal direction. Data is displayed by applying it to an intersection between the data line and the gate line. Actually, data is written to one lateral line by applying analog voltage to the data lines, and applying positive voltage to one intended gate line and negative voltage to remaining gate lines.

As described, although the voltage applied to the data line is analog voltage, data is usually manipulated as digital signals in a computer to which the TFT liquid crystal display panel is attached. Therefore, image data is subject to digital-to-analog conversion (D/A conversion) somewhere. Because the position where D/A conversion is taken place varies from a computer to another, the type of signal to be handled varies from a computer to another. Thus, so-called TFT liquid crystal display panel drivers are categorized into a analog method and a digital method.

The digital method handles the image data in digital signals, and is an approach in which D/A converters (DACs) are arranged in an output stage of the driver in the number of pixels in the lateral direction of the screen, and the image data is written in each line. That is, video signals output from the computer are handled in the digital form until the data line of the TFT liquid crystal display panel, and converted into analog signals just before supply to the data line. Subcategories of this include an approach where analog video signals for a CRT interface output from the computer are once converted into digital signals through analog-to-digital conversion (A/D conversion), supplied to the driver for the TFT liquid crystal display panel, and then digital-to-analog converted for supply to the data line (for example, PUPA 3-125582). This is also considered to be the digital method.

Such digital method has such characteristics that a highly even image can be obtained by an arrangement where reference voltage and switches in the number corresponding to gradations are prepared and the switches corresponding to the gradations are closed (a so-called switch system).

However, the digital method has a disadvantage that, because the circuit size is increased in proportional to the number of gradations, it becomes difficult to form the circuit in an integrated circuit when the number of gradations is increased. In addition, in case of the digital method, it is usual to use +5 V as the supply voltage. However, it is impossible to assure amplitude of about ±5 V necessary for driving the TFT liquid crystal display panel as is. Voltage with a constant polarity cannot be continuously supplied to each cell of the liquid crystal display panel to prevent damage on the liquid crystal. In this regards, a circuit technique called AC common driving is used to increase the apparent operating voltage. The AC common driving is to move in parallel the output voltage of the driver apparently as, for example, from −5 V to 0 V, and then from 0 V to +5 V. However, additional several microseconds becomes necessary to attain the AC common driving, which provides a limitation on the operating speed. It is difficult to perform the AC common driving in a case of the TFT liquid crystal display panel with high resolution where the write time is critical. In addition, when the AC common driving is used, the drive method for the TFT liquid crystal display panel is limited to one called the H inversion. The H inversion is prone to cause crosstalk so that there arise problems in the image quality. Here, the H inversion means to apply voltage with different polarities to the pixels adjacent in the longitudinal direction of the screen. That is, voltage with the same polarity is applied in the lateral direction of the screen.

On the contrary, the analog method is to handle the image data output from the computer as analog signals from the stage of input of the driver of the TFT liquid crystal display panel. In the analog method, sample hold circuits are arranged by the number of pixels in the lateral direction of the screen to prepare analog signals to be supplied to each data line. Then, in the analog method, the quality of image depends on the performance of the sample hold circuit as is so that circuit technique, manufacturing technique, and mounting technique at a high level are required to obtain an image with high quality.

However, the circuit size in the analog method is constant regardless of the gradations of image, and small. In addition, because the degree of freedom is high in handling voltage when compared with the digital method, the above-mentioned circuit technique of AC common driving becomes unnecessary so that the operating speed of the liquid crystal display panel is improved. This is particularly effective for the liquid crystal display panel with high resolution since write time is critical for such display panel. In addition, it becomes possible to use a technique called HV inversion in which crosstalk is most difficult to occur is used to drive the TFT liquid crystal display panel. The HV inversion means to apply voltage with different polarities to both the longitudinal and lateral directions of the screen. That is, the voltage is applied as:

+−+−+−(line n)

−+−+−+(line n+1).

Although the analog method is so useful, it provides less stability of image than the digital method. That is, because the analog method lacks noise immunity, the quality of image is degraded by thermal drift, chip dispersion, drift of supplied voltages or the like. In addition, as, after passing through the driver for the liquid crystal panel, analog signals are supplied to the data lines through a sample hold circuit and a buffer amplifier, these circuits also generate errors.

Approaches for compensating such disadvantages in the analog method include PUPA 5-173504. This approach previously stores compensation information corresponding to the characteristics of the data electrode driver, and uses such information to compensate the analog voltage. There is still a disadvantage in this approach that it cannot cope with thermal drift once it occurs.

SUMMARY OF THE INVENTION

Accordingly, an object of the present invention is to provide a driver for the TFT liquid crystal display panel which can cope with chip dispersion, thermal drift and drift of supplied voltages.

Also, it is an object to generate general error voltage due to drift of temperature and supplied voltages by emulating a driver circuit for the TFT liquid crystal display panel and circuits corresponding to respective display cells of the liquid crystal display panel, and to compensate video signals with the error voltage.

Furthermore, it is an object to improve image quality and to provide an image with high stability by providing such driver.

The present invention is to attain the above-mentioned objects, and is an analog video signal compensating apparatus comprising a reference voltage generator; a TFT emulator circuit having a quasi-circuit including a buffer amplifier equivalent circuit equivalent to a buffer amplifier used for driving a TFT liquid crystal display panel and a display cell equivalent circuit equivalent to a display cell in the TFT liquid crystal display panel, and a control circuit for controlling a supply of an output from the reference voltage generator to the quasi-circuit, for outputting a response of the quasi-circuit for the output from the reference voltage generator; a difference detecting circuit for detecting a difference between the output of the reference voltage generator and an output of the TFT emulator circuit; and a compensating circuit for compensating analog video signals by an output from the difference detecting circuit. This apparatus enables it to dynamically compensate the analog signals.

The TFT emulator circuit may further include an equivalent circuit equivalent to a sample hold circuit used for driving the TFT liquid crystal display.

In addition, it is contemplated that the output of the reference voltage generator includes a positive output and a negative output, and the TFT emulator circuit includes a plural sets of quasi-circuits, and the control circuit alternately supplies the positive and negative outputs to each set of the quasi-circuits in a different mode, and the responses from the set of quasi-circuit where a gate in the display cell equivalent circuit is activated and to which the positive and negative outputs are inputted are arranged to be outputted as the respective outputs of the TFT emulator circuit.

Another aspect of the present invention is an analog video signal compensating apparatus comprising a reference voltage generator; a TFT emulator circuit having a quasi-circuit including an equivalent buffer amplifier equivalent to a buffer amplifier used for driving a TFT liquid crystal display panel, and a control circuit for controlling a supply of an output from the reference voltage generator to the quasi-circuit, for outputting a response of the quasi-circuit for the output from the reference voltage generator; a difference detecting circuit for detecting a difference between the output of the reference voltage and an output of the TFT emulator circuit; and a compensating circuit for compensating analog video signals by an output from the difference detecting circuit.

It may be also contemplated that a TFT liquid crystal display device includes the analog video signal compensating apparatus as described above.

In the arrangement of the first described invention, reference voltage generated from the reference voltage generator is input by a control circuit to the display cell equivalent circuit driven by a buffer amplifier equivalent circuit and the control circuit, and its response is output from the TFT emulator circuit. Then, the difference detecting circuit compares that output with the reference voltage from the reference voltage generator, and outputs an output signal corresponding to the difference to the compensating circuit. The compensating circuit compensates with its output the analog video signals generated in the precious stage. The compensated analog video signals are output to the TFT liquid crystal display panel through the sample hold circuit and the buffer amplifier.

It is also true for a quasi-circuit further including a quasi-circuit of a sample hold circuit that the reference voltage generated by the reference voltage generator is supplied to such circuit.

In a case where there is a plurality sets of the above-mentioned quasi-circuits, the control circuit supplies a positive reference voltage (positive output) and a negative reference voltage (negative output) to each of the quasi-circuits so that the positive and negative reference voltages alternately occurs in the quasi-circuit, and transition between positive and negative occurs at different time. Then, of the plurality sets of quasi-circuits, those the gate of the display cell included in which is energized, and which, after the positive or negative voltage is supplied, maintains that voltage are selected, and their outputs are output to the difference detecting circuit. The difference detecting circuit compares respective outputs with the reference voltage with the same polarity to generate outputs corresponding to the difference.

In addition, the operation is not changed even if the quasi-circuit included in the TFT emulator circuit is a quasi-circuit of a buffer amplifier.

BRIEF DESCRIPTION OF THE DRAWINGS

FIG. 4 is waveforms for illustrating the operation.

DESCRIPTION OF THE PREFERRED EMBODIMENTS

Figure 1:
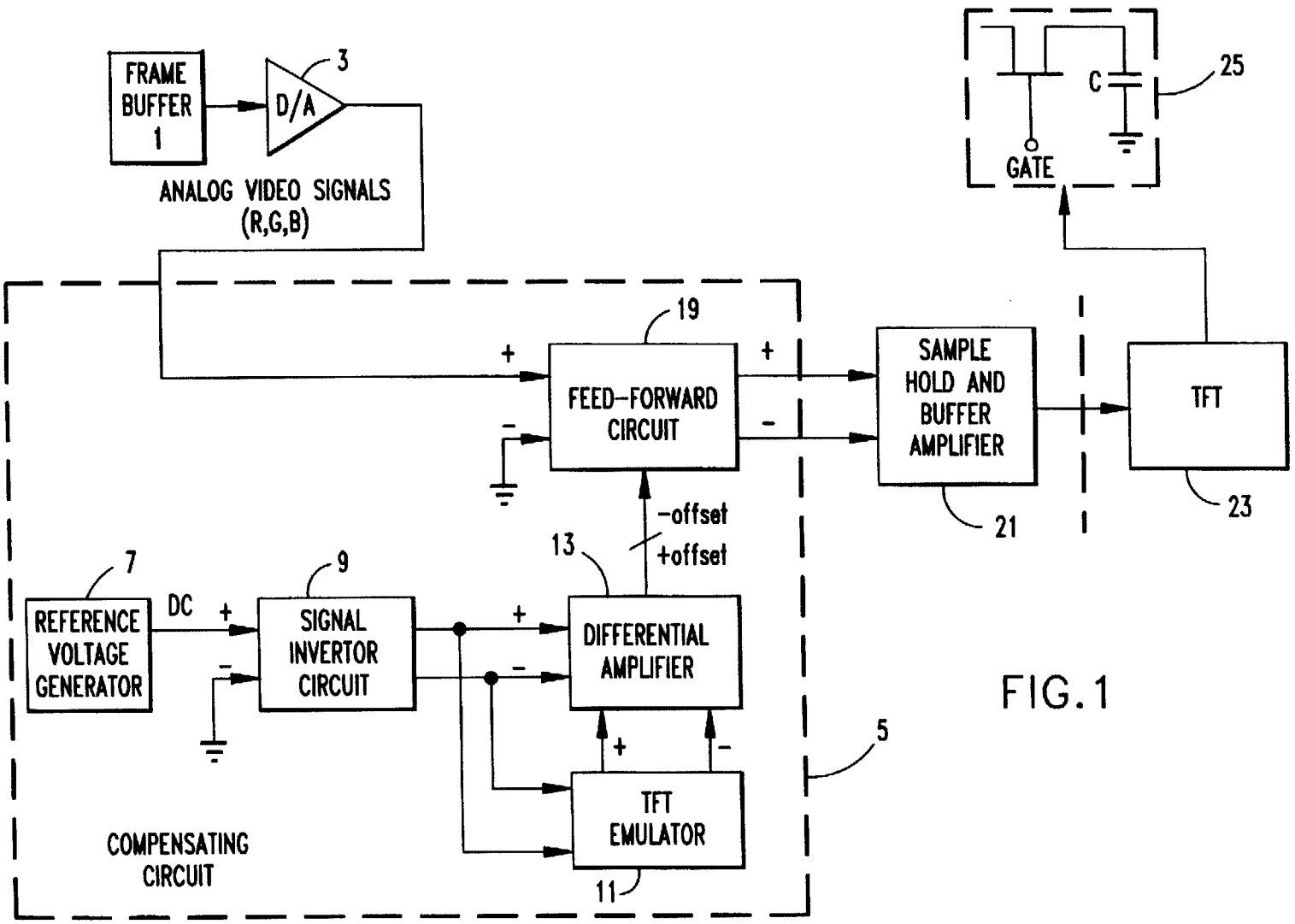
FIG. 1 is a schematic view of the present invention.

FIG. 1 shows a schematic view of the present invention. A frame buffer 1 stores digital image data to be displayed. Then, the image data is arranged to be read from the frame buffer 1, and converted into analog image data (analog video signals) by a D/A converter 3. Although not explicitly shown in FIG. 1, the D/A converter 3 is arranged to perform γ correction as well. The analog video signals are input to a feed-forward circuit 19 of a compensating circuit 5.

The compensating circuit 5 includes a reference voltage generator 7 and a signal invertor circuit 9. The reference voltage generator 7 is connected to the signal invertor circuit 9, and the output of the signal invertor circuit 9 is input to a TFT emulator 11 and a differential amplifier 13. The signal invertor circuit 9 consists of two pairs of complemental differential circuits and generates positive and negative outputs symmetric to the ground (GND). The differential amplifier 13 is connected to the feed-forward circuit 19, and the output of which is input to sample hold circuits and buffer amplifiers 21 which exist in the number corresponding to those of data lines. The analog video signals are supplied to each pixel by the data lines connected to the buffer amplifiers 21 so that an image is generated on a TFT liquid crystal display device 23. Although it is preferable to mount the compensating circuit 5 the sample hold circuits and buffer amplifiers 21 on the same semiconductor chip, the D/A converter 3 may be included on the same chip or on a separate chip.

Here, the operation of the arrangement shown in FIG. 1 will be explained. The digital video signals read from the frame buffer 1 are converted into analog video signals by the D/A converter 3. In addition, the reference voltage generator 7 outputs a reference voltage with one polarity to the signal invertor circuit 9 which in turn generates reference voltages with both positive and negative polarities. The two reference voltages are input to the TFT emulator 11. The TFT emulator 11 performs emulation by the buffer amplifier 21 which is a circuit after the compensating circuit 5, and a quasi-circuit of one display cell of the TFT liquid crystal display panel 23, and outputs the result of emulation to the differential amplifier 13. The TFT emulator 11 has two outputs in correspondence to two reference voltages. The differential amplifier 13 compares two outputs of the TFT emulator 11 and two outputs of the signal invertor circuit 9, and outputs difference for those with the same polarity. Then, the feed-forward circuit 19 performs compensation of the input analog video signals by referencing the difference generated by the differential amplifier 13.

Thus, the analog video signals are compensated, and the compensated analog video signals are supplied to the sample hold circuit and buffer amplifiers 21. Then, the analog voltage is supplied to each pixel of the TFT liquid crystal panel to generate an image on the pixels. If the sample hold circuits and buffer amplifiers 21 and the compensator circuit 5 are on the same chip, they are thermally coupled, and there are small errors between devices on the same chip so that they can effectively and dynamically accommodate drifts in temperature and supplied voltages. In addition, the TFT liquid crystal display panel 23 is not considered to be located remote from the compensating circuit 5 so that it is suitable for emulation.

Figure 2:
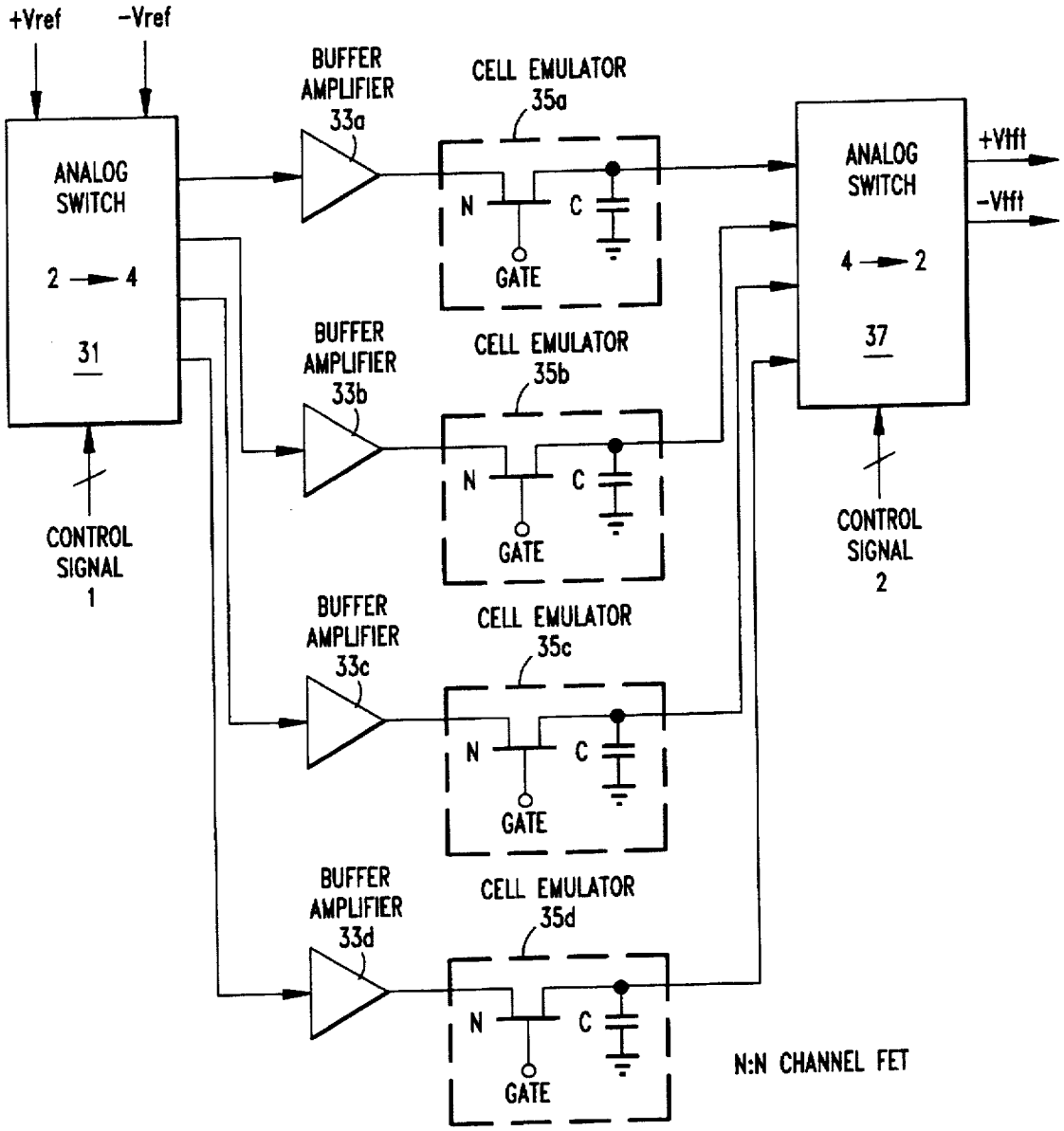
FIG. 2 is a schematic view of essential components of the present invention.

FIG. 2 shows the TFT emulator 11 in detail. +Vref and −Vref are two reference voltages generated by the signal invertor 9. The two reference voltages are arranged to be supplied to an analog switch 31. The analog switch 31 distributes the two reference voltages into four outputs to generate waveforms shown in FIGS. 4(*a*)–(*d*) which are described later. This is intended to emulate the operation of HV inversion in the TFT emulator 11 and to use the result for operating the actual TFT liquid crystal display panel in the HV inversion. Each circuit for emulation (quasi-circuit) comprises a buffer amplifier 33, and a cell emulator 35 which is a quasi-circuit of one display cell of the TFT liquid crystal display panel. The output of each cell emulator 35 is connected to an analog switch 37, and outputs suitable outputs as +Vtft and −Vtft at suitable timing to the differential amplifier 13.

The cell emulator 35 incorporates a field effect transistor (FET) the gate of which is controlled by gate signals 0 and 1 with a control circuit (not shown) so as to emulate the HV inversion for the gate voltage. The gate signals will be also described later. Four outputs are input to the analog switch 37. A control circuit (not shown) controls the analog switch 37 with a control signal 2 to select suitable two of the four outputs as +Vtft and −Vtft as described above. The control signal 2 will be also described later. Thus, +Vtft and −Vtft are supplied to the differential amplifier 13.

As described, the TFT emulator 11 incorporates the analog switches 31 and 37 which are factors affecting the signal. However, since the impact by the analog switch circuits is smaller than other two factors, it is allowed. However, the error in the analog switch circuits should be made as small as possible.

In addition, a capacitor (capacitance) C constituted in the cell emulator 35 is determined for its value by taking the capacitance by the liquid crystal and parasitic capacitance between the gate and the source of the FET into account because the actual TFT liquid crystal display panel is represented by an equivalent circuit 25.

Figure 3:
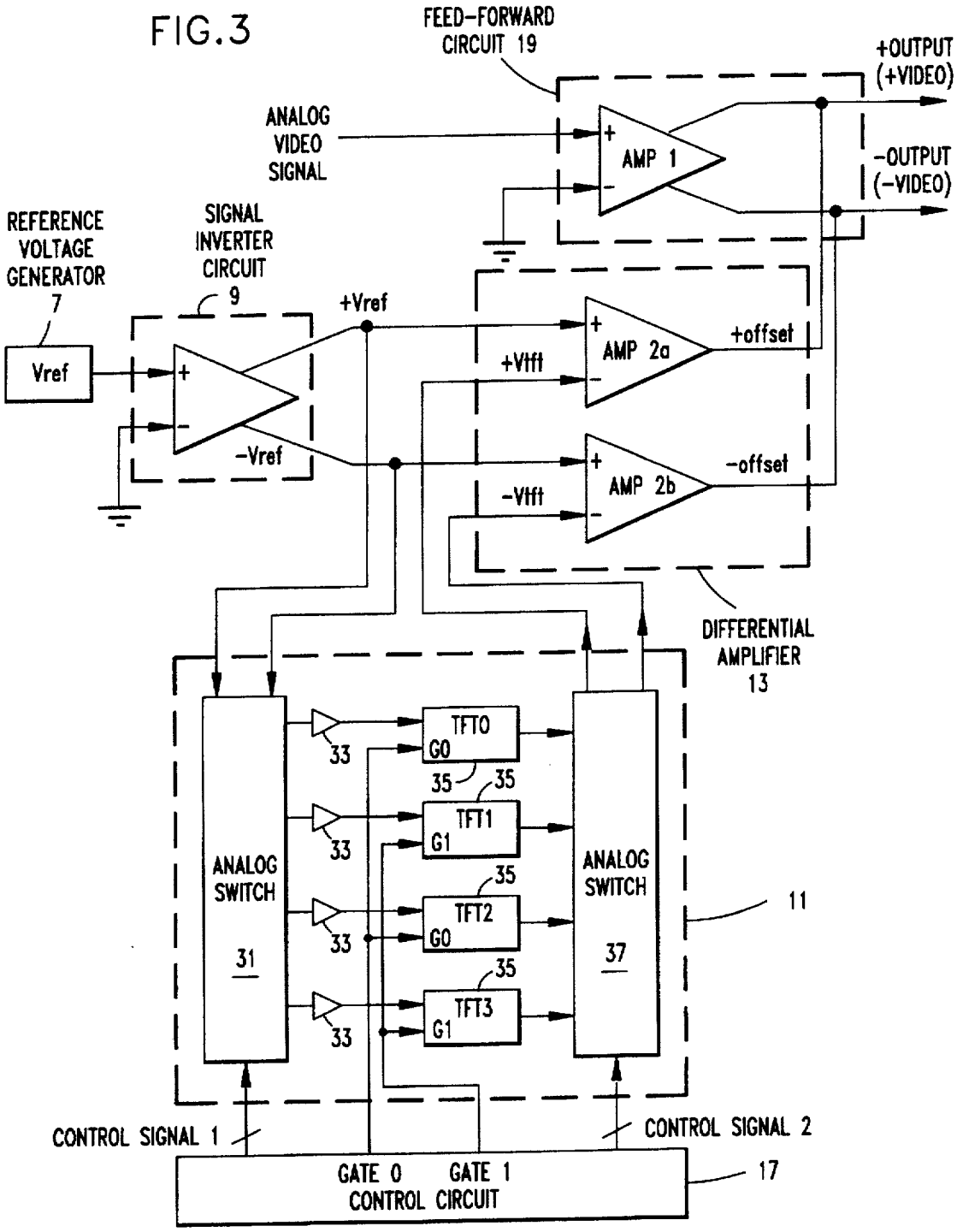
FIG. 3 shows details of FIG. 1.

FIG. 3 shows the compensating circuit 35 in detail. Since it is substantially same as FIG. 1, there is no need to describe the reference voltage generator 7, the signal invertor circuit 9, the TFT emulator 11, and the differential amplifier 13. The feed-forward circuit 19 is arranged to divide the analog video signals into two positive and negative signals, and to add positive and negative offset signals which are generated in the differential amplifier 13 from the respective signals. This enables it to cancel distortion by direct current components in the TFT liquid crystal display panel and a system for driving it generated by the TFT emulator 11 and the differential amplifier 13.

In addition, the TFT emulator 11 operates to emulate the HV inversion, and is controlled by the control signal 1 and 2 as well as the gate signals 0 and 1 of the control circuit 17 in FIG. 3. The control of the control circuit 17 is generally shown in FIG. 4. The temporal divisions in the figure show the period of time necessary for writing for one line.

The control signal 1 is used for controlling the analog switch 31, and requires to perform the emulation by changing the reference voltage in a form to perform the HV inversion. The analog switch 31 is arranged to supply signals as shown in FIGS. 4(*a*), (*b*), (*c*) and (*d*) to the above-mentioned four quasi-circuits for emulation, and the control circuit 17 supplies the control signal 1 for it. Here, a dotted line at the center of each of (*a*)–(*d*) is a line representing 0 V. Its upper side represents the positive polarity, while the lower side represents the negative polarity. Since outputs from the signal invertor circuit 9 are output as shown in FIGS. 4(*a*)–(*d*), the amplitude is the positive and negative Vref.

The gate 0 signal is input to the FET in the cell emulators 35*a* and 35*c* (FIG. 4 (e)). In addition, the gate 1 signal is input to the FET in the cell emulators 35*b* and 35*d* (FIG. 4(*f*)). As shown in the figure, the FET becomes the sample mode when applying voltage with positive polarity, and the hold mode when applying voltage with negative polarity. Because the FET holds the output from the buffer amplifier and displays one data on the cell of the TFT liquid crystal display panel, the hold mode represents the actual display state. Although the amplitude between the gate 0 signal and the gate 1 signal is indicated as ±Vcc in FIG. 4, it may be any voltage at which the FET input with the signal can operate.

The signals after passing through the buffer amplifier 33 and the cell emulator 35 are deformed under the distortion of the system as shown in FIGS. 4(*g*), (*h*), (*i*), and (*j*). However, because they vary to substantially settle at +Vtft or −Vtft, the analog switch 37 is arranged to select an output which settles at +Vtft or −Vtft in each interval of time, and at which the FET in the cell emulator 35 is the hold mode, and to be supplied with the control signal 2 for it. Then, the inputs to Amp2*a* and Amp2*b* shown in FIG. 3 become as shown in FIGS. 4(*k*) and (*l*). Outputs of the quasi-circuit being selected are shown in FIGS. 4(*k*) and (*l*), are initially TFT2out and TFT0out.

With such arrangement, differences between the reference voltages (±Vref) from the signal invertor circuit 9 and the outputs (±Vtft) of the quasi-circuit are generated by Amp2*a* and Amp2*b*, and positive and negative offset signals are output (FIGS. 4(*m*) and (*n*)). The positive and negative offset signals causes the positive and negative analog video signals generated by the feed-forward circuit 19 to be added so that waveforms shown in FIGS. 4(*o*) and (*p*) are generated. In FIGS. 4(*o*) and (*p*), broken lines indicate the signals before compensation, while solid lines indicate the signals after compensation.

Although the arrangement described above enables it to cancel the distortion in the system by drift of supplied voltages and thermal drift, the present invention is not limited to the above embodiment. That is, although, in the above, the TFT emulator 11 is arranged by assuming to perform the HV inversion, the TFT emulator 11 may be modified so that it is arranged and operated to perform the H inversion. In such case, the associated differential amplifier 13, the feed-forward circuit 19 and the like are modified accordingly. In addition, the signal invertor circuit 9, the differential amplifier 13, the feed-forward circuit 19, the analog switch 37 in the TFT emulator 11 and the like may be replaced with other circuits respectively performing the same function.

Furthermore, although the present invention emulates the circuits after the sample hold circuit, because the TFT liquid crystal display panel is not included on the same semiconductor chip, emulation may be performed for the sample hold circuit and the buffer amplifier, particularly the buffer amplifier, except for the cells. This is because it is a circuit on the same semiconductor chip, and attains the same effect in accommodation to thermal drift and drift of supplied voltages due to thermal coupling.

As described, it is possible to provide a driver for the TFT liquid crystal display panel which can accommodate chip dispersion, and drift of temperature and supplied voltages.

In addition, the video signals can be compensated by generating and using general error voltage for drift of temperature and supplied voltages with emulation of the circuits after the driver for the TFT liquid crystal display panel, the circuit corresponding to one display cell of the liquid crystal panel, and the like.

Furthermore, provision of the driver as described above enables it to improve the quality of image, and to provide an image with high stability.

We claim:

1. An analog video signal compensating apparatus comprising:

a reference voltage generator;

a TFT emulator circuit having a quasi-circuit including a buffer amplifier equivalent circuit equivalent to a buffer amplifier used for driving a TFT liquid crystal display panel and a display cell equivalent circuit equivalent to a display cell in said TFT liquid crystal display panel, and a control circuit for controlling a supply of an output from said reference voltage generator to said quasi-circuit and a driver of said display cell equivalent circuit, for outputting a response of said quasi-circuit for said output from said reference voltage generator;

a difference detecting circuit for detecting a difference between said output of said reference voltage generator and an output of said TFT emulator circuit; and a compensating circuit for compensating analog signals by an output from said difference detecting circuit.

2. An analog video signal compensating apparatus as set forth in claim 1, wherein said TFT emulator circuit further includes an equivalent circuit equivalent to a sample hold circuit used for driving the TFT liquid crystal display.

3. An analog video signal compensating apparatus as set forth in claim 1, wherein the output of the reference voltage generator includes a positive output and a negative output, and the TFT emulator circuit includes a plural sets of quasi-circuits, and the control circuit alternately supplies the positive and negative outputs to each set of the quasi-circuits in a different mode, and the responses from the set of quasi-circuit where a gate in the display cell equivalent circuit is activated and to which the positive and negative outputs are inputted are arranged to be outputted as the respective outputs of the TFT emulator circuit.

4. A TFT liquid crystal display device comprising:

a TFT liquid crystal display panel;

a reference voltage generator;

a TFT emulator circuit having a quasi-circuit including a buffer amplifier equivalent circuit equivalent to a buffer amplifier used for driving a TFT liquid crystal display panel and a display cell equivalent circuit equivalent to a display cell in said TFT liquid crystal display panel, and a control circuit for controlling a supply of an output from said reference voltage generator to said quasi-circuit and a driver of said display cell equivalent circuit, for outputting a response of said quasi-circuit for said output from said reference voltage generator;

a difference detecting circuit for detecting a difference between said output of said reference voltage generator and an output of said TFT emulator circuit;

a compensating circuit for compensating analog video signals by an output from said difference detecting circuit; and a sample hold circuit connected to said compensating circuit; wherein said buffer amplifier is connected to said sample hold circuit.

5. An analog video signal compensating apparatus comprising:

a reference voltage generator;

a TFT emulator circuit having a quasi-circuit including an equivalent buffer amplifier equivalent to a buffer amplifier used for driving a TFT liquid crystal display panel, and a control circuit for controlling a supply of an output from said reference voltage generator to said quasi-circuit, for outputting a response of said quasi-circuit for said output from said reference voltage generator;

a difference detecting circuit for detecting a difference between said output of said reference voltage generator and an output of said TFT emulator circuit; and a compensating circuit for compensating analog video signals by an output from said difference detecting circuit.

6. A TFT liquid crystal display device comprising:

a TFT liquid crystal display panel;

a reference voltage generator;

a TFT emulator circuit having a quasi-circuit including an equivalent buffer amplifier equivalent to a buffer amplifier used for driving a TFT liquid crystal display panel, and a control circuit for controlling a supply of an output from said reference voltage generator to said quasi-circuit, for outputting a response of said quasi-circuit for said output from said reference voltage generator;

a difference detecting circuit for detecting a difference between said output of said reference voltage generator and an output of said TFT emulator circuit;

a compensating circuit for compensating analog video signals by an output from said difference detecting circuit; and a sample hold circuit connected to said compensating circuit; wherein said buffer amplifier is connected to said sample hold circuit.

* * * * *